US005246629A

United States Patent [19]

Fukumoto et al.

[11] Patent Number: 5,246,629

[45] Date of Patent: Sep. 21, 1993

[54] LIQUID DETERGENT COMPOSITION

[75] Inventors: Yoshinori Fukumoto, Chiba; Yoko Miyashita, Tokyo; Takashi Nishino, Ichikawa; Seiichi Ota, Chiba, all of Japan

[73] Assignee: Lion Corporation, Tokyo, Japan

[21] Appl. No.: 733,160

[22] Filed: Jul. 19, 1991

[30] Foreign Application Priority Data

Jul. 26, 1990 [JP] Japan ..... 2-199760

[51] Int. Cl.[5] ..... C11D 1/18

[52] U.S. Cl. ..... 252/546; 252/547; 252/550; 252/551; 252/DIG. 10

[58] Field of Search ..... 252/546, 547, 550, 551, 252/DIG. 10

[56] References Cited

U.S. PATENT DOCUMENTS

| | | | |
|---|---|---|---|
| 4,148,762 | 4/1979 | Koch et al. | 252/DIG. 5 |
| 4,832,872 | 5/1989 | Scandel | 252/547 |
| 4,877,546 | 10/1989 | Lai | 252/545 |
| 5,108,660 | 4/1992 | Michael | 252/DIG. 10 |

*Primary Examiner*—Patrick P. Garvin
*Assistant Examiner*—E. D. Irzinski
*Attorney, Agent, or Firm*—Wegner, Cantor, Mueller & Player

[57] ABSTRACT

A liquid detergent composition contains:

(A) an anionic surfactant having the formula (I):

$$RO(CH_2CH_2O)_nSO_3M \quad (I)$$

wherein R is a $C_{10}$–$C_{18}$ alkyl or alkenyl group, n is 0 to 5, and

M is hydrogen, an alkaline metal cation, an alkaline earth metal cation, an ammonium cation or a substituted ammonium cation; and (B) an amphoteric ion surfactant having the formula (II):

$$R'-\overset{\overset{CH_3}{|}}{\underset{\underset{CH_3}{|}}{N}}^{+}-CH_2COO^- \quad (II)$$

wherein R' is a $C_{10}$–$C_{16}$ alkyl or alkenyl group, provided that the weight ratio of component (A) to a total amount of components (A) and (B) is 0.2 to 0.8 and the total amount of components (A) and (B) is 0.05% to 0.3% by weight.

4 Claims, No Drawings

LIQUID DETERGENT COMPOSITION

BACKGROUND OF THE INVENTION

1. Field of the Invention

The present invention relates to a liquid detergent composition suitable for use as a domestic detergent and for the cleaning of a wide variety of articles from furniture and floors to glass articles.

2. Description of the Related Art

Domestic detergents for furniture, glass, oil stains, toilets bathrooms, respectively, are widely used.

In particular, as the detergent for glass and furniture, there are known in the art a detergent comprising a combination of a specific nonionic surfactant with a polyoxyethylenealkylsulfates and blended with an organic solvent (see Japanese Unexamined Patent Publication (Kokai) No 58-21495), a detergent comprising a surfactant and blended with a salt of a water-soluble polymer and a lower alcohol or a glycol ether (see Japanese Unexamined Patent Publication (Kokai) No. 49-23208), and a detergent comprising a blend of a betaine amphoteric surfactant with an alkylammonium cationic surfactant (see Japanese Unexamined Patent Publication (Kokai) No. 63-309594).

Some of the above-mentioned detergents provide a satisfactory detergency, but leave streaks after use which makes it necessary to again wipe the article to remove streaks and obtain a clean finish. Some of the detergents do not leave streaks after use but have a drawback of an insufficient detergency, and accordingly, the known detergents cannot simultaneously satisfy the requirements for a strong detergency without leaving streaks.

The use of highly volatile alkaline agents, such as ammonia and morpholine, is considered to be useful for alleviating the problem of leaving streaks, but this method has its limits. Further, the smell of the highly volatile alkaline agent described above is so strong that it becomes necessary to blend a strong perfume therewith, to mask the smell, which causes the detergent to give off a strong smell during and after the use thereof.

SUMMARY OF THE INVENTION

Accordingly, the objects of the present invention are to eliminate the above-mentioned disadvantages of the prior art and to provide a liquid detergent composition suitable for use as a domestic detergent and exhibiting a strong detergency, even with a small surfactant content, against various stains to be removed by wiping, and further, does not leave streaks after the use thereof.

Other objects and advantages of the present invention will be apparent from the following description.

In accordance with the present invention, there is provided a liquid detergent composition comprising:

(A) an anionic surfactant having the formula (I):

$$RO(CH_2CH_2O)_nSO_3M \quad (I)$$

wherein R is a $C_{10}$–$C_{18}$ alkyl or alkenyl group, n is 0 to 5, and

M is hydrogen, an alkaline metal cation, an alkaline earth metal cation, an ammonium cation or a substituted ammonium cation;

(B) an amphoteric ion surfactant having the formula (II):

$$R'-\overset{\overset{CH_3}{|}}{\underset{\underset{CH_3}{|}}{N}}^{+}-CH_2COO^{-} \quad (II)$$

wherein R' is a $C_{10}$–$C_{16}$ alkyl or alkenyl group; and (C) water provided that the weight ratio of component (A) to a total amount of components (A) and (B) is 0.2 to 0.8 and the total amount of components (A) and (B) is 0.05% to 0.3% by weight.

DESCRIPTION OF THE PREFERRED EMBODIMENTS

The present invention will now be described in more detail.

The anionic surfactant usable as the component (A) in the present invention is an alkyl (or alkenyl) sulfate ester or a salt thereof or a polyoxyethylenealkyl (or alkenyl) sulfate ester or a salt thereof, and is preferably those having R in the formula (I) of a straight-chain alkyl group having 10 to 16 carbon atoms, and n represents an average addition mole number of ethylene oxide and is 0 to 5. Examples of the salt include an alkali metal salt, an alkaline earth metal salt, an ammonium salt and a substituted ammonium salt such as an alkanolamine salt, but the alkaline metal (e.g., Na, K) salt and alkanolamine (e.g., those having 1 to 3 carbon atoms) salt are preferred.

Specific examples of the component (A) are a salt of lauryl sulfate, a salt of myristyl sulfate, a salt of polyoxyethylene (n=3) lauryl ether sulfate, a salt of polyoxyethylene (n=5) myristyl ether sulfate, a salt of polyoxyethylene (n=3) undecyl ether sulfate, and a salt of polyoxyethylene (n=4) tridecyl ether sulfate, wherein n represents an average number of moles of added ethylene oxide.

The amphoteric surfactant usable as the component (B) of the present invention is N-alkyl (or alkenyl)-N,N-dimethyl-N-carboxymethyl-ammoniumbetaine (alkyldimethylaminoacetic acid betaine) and is preferably one having R' in the formula (II) of a straight-chain alkyl group having 10 to 14 carbon atoms.

Specific examples of the component (B) are lauryldimethylaminoacetic acid betaine, dimethylaminoacetic acid betaine from coconut, myristyldimethylaminoacetic acid betaine and palmityldimethylaminoacetic acid betaine.

The blending ratio of component (A) to a total amount of the components (A) and (B) is 0.2 to 0.8, in terms of (A)/[(A)+(B)] on a weight basis, and the total amount of the components (A) and (B) is 0.05 to 0.3% by weight, preferably 0.1 to 0.2% by weight.

In the present invention, when the component (A) or (B) is used alone, it is impossible to simultaneously meet both of the requirements for a strong detergency and no streaks after use; these requirements can be simultaneously met only by blending the components (A) and (B) in the above-mentioned ratio and amount of blending, to thus prepare a liquid detergent composition.

Specifically, when the blending ratio is outside the above-described range, the streaks after use are very noticeable or the detergency strength is lowered. When the total amount of the blending of the components (A) and (B) is less than 0.05% by weight, the detergency is insufficient. On the other hand, when the total amount exceeds 0.3% by weight, no significant improvement in the detergency strength is obtained and the streaks after use become very noticeable.

In addition to the above-described two components (A) and (B), optional components may be added to the liquid detergent composition of the present invention according to need. For example, an alkaline agent can be added to adjust the pH of the composition to 8 to 12. Examples of the alkaline agent are monoethanolamine, diethanolamine, triethanolamine, diethylaminoethanol, morpholine, and ammonia. In the present invention, due to the specific combination of two types of surfactant, not only can the amount of blending of the surfactant be smaller than that in the prior art but also the problem of streaks can be eliminated, and therefore, alkalizing agents less liable to give off a smell of amine and able to greatly contribute to the detergency, such as alkanolamines including monoethanolamine, can be freely used without limitation, contrary to the use of morpholine or ammonia as a volatile alkalizing agent, which leaves no streaks after use because it vaporizes in the air but gives off a strong smell of amine.

It is possible to add a solvent, to facilitate the removal of oily satins through a dissolution of the stains in the solvent, and at the same time, prevent a precipitation of the components and a freezing of the composition at a low temperature. Examples of the solvent usable in the present invention are lower alcohols such as methanol, ethanol and isopropanol, and glycols such as ethylene glycol and propylene glycol.

Further, it is possible to add, as chelating agents, aminocarboxylic acids, such as ethylenediaminetetraacetic acid (EDTA) and diethylenetriaminepentaacetic acid, citric acid and pyrophosphoric acid or salts thereof; low-temperature stabilizers such as toluenesulfonic acid or salt thereof; and auxiliary components such as perfumes colorants and anti-fungus agents.

According to the present invention, the liquid detergent composition comprising specific surfactants in a specific ratio and total amount exhibits a strong detergency effect against various stains to be removed by wiping and provides an excellent finish without streaks, after use.

The constitution and effect of the present invention will now be described in more detail by way of the following Examples. Prior to the description of the Examples, the method of evaluating the detergency and streaks will be described.

(1) Detergency

A plate was stained with fresh oil splashed on the floor in front of a kitchen range.

A liquid detergent was applied to the stained plate, and the plate was then wiped with a cotton knit cloth, by reciprocating the cloth twice under a load of 200 g. The state of the staining was evaluated by the naked eye, according to the following criteria.

++: very good removal of stain
+: good removal of stain
±: uneven removal of stain
−: substantially no removal of stain (2) Streaks A liquid detergent was applied to a window glass and furniture comprising a black decorative sheet, and the liquid detergent was wiped with a dried cotton knit cloth, by reciprocating the cloth twice. The streaks on the surface of the furniture after the wiping were evaluated by the naked eye according to the following criteria.

++: excellent finish with no streaks
+: good finish with substantially no streaks
±: slightly poor finish with streaks
−: poor finish with very large amount of streaks

Examples

The present invention will now be further illustrated by, but is by no means limited to, the following Examples.

The liquid detergent compositions shown in Table 1 were prepared, and an evaluation thereof was conducted with regard to the detergency and amount of streaks remaining. The results are shown in Table 1.

TABLE 1

| | Sample No. | | | Example 1*6 | 2*7 | 3*7 | 4*7 | 5*7 | 6*7 |
|---|---|---|---|---|---|---|---|---|---|
| Composition (wt. %) | ethanol | | | 3 | 3 | 3 | 3 | 3 | 3 |
| | monoethanolamine | | | 1.5 | 1.5 | 1.5 | 1.5 | 1.5 | 1.5 |
| | perfume | | | 0.05 | 0.05 | 0.05 | 0.05 | 0.05 | 0.05 |
| | EDTA | | | 0.05 | 0.05 | 0.05 | 0.05 | 0.05 | 0.05 |
| | Water | | | balance | | | | | |
| | surfactant | (A)*1 | R*3 | n-$C_{12}H_{25}$ | n-$C_{16}H_{33}$ | n-$C_{12}H_{25}$ | n-$C_{12}H_{25}$ | n-$C_{13}H_{27}$ | i-$C_{12}H_{25}$ |
| | | | n | 3 | 5 | 3 | 3 | 2 | 1 |
| | | | M | Na | Na | Na | Na | MFA*4 | Na |
| | | | amt. of blend (wt. %) | 0.005 | 0.025 | 0.06 | 0.10 | 0.08 | 0.12 |
| | | (B)*2 | R*3 | n-$C_{12}H_{25}$ | coconut*5 ($C_{12}$, $C_{14}$) | n-$C_{12}H_{25}$ | n-$C_{12}H_{25}$ | n-$C_{12}H_{25}$ | n-$C_{14}H_{29}$ |
| | | | amt. of blend (wt. %) | 0.005 | 0.025 | 0.04 | 0.08 | 0.18 | 0.18 |
| | (A) | | | 0.5 | 0.5 | 0.6 | 0.56 | 0.31 | 0.4 |
| | (A) + (B) [wt. % ratio] | | | | | | | | |
| | (A) + (B) [wt. % ratio] | | | 0.01 | 0.05 | 0.10 | 0.18 | 0.26 | 0.30 |
| Evaluation | detergency | | | − | + | ++ | ++ | ++ | + |
| | streaks | window glass | | + | ++ | ++ | ++ | + | + |
| | | furniture | | + | ++ | ++ | ++ | + | + |

| | Sample No. | Example 7*7 | 8*6 | 9*6 | 10*6 | 11*6 | 12*6 |
|---|---|---|---|---|---|---|---|
| Composition (wt. %) | ethanol | 3 | 3 | 3 | 3 | 3 | 3 |
| | monoethanolamine | 1.5 | 1.5 | 1.5 | 1.5 | 1.5 | 1.5 |
| | perfume | 0.05 | 0.05 | 0.05 | 0.05 | 0.05 | 0.05 |
| | EDTA | 0.05 | 0.05 | 0.05 | 0.05 | 0.05 | 0.05 |

TABLE 1-continued

| | | | | | | | | |
|---|---|---|---|---|---|---|---|---|
| | Water | | | | | balance | | |
| | surfactant | (A)*1 | R*3 | n-$C_{10}H_{21}$ | n-$C_{12}H_{25}$ | — | n-$C_{12}H_{25}$ | n-$C_{14}H_{29}$ | n-$C_{12}H_{25}$ |
| | | | n | 0 | 3 | — | 3 | 4 | 3 |
| | | | M | Na | Na | — | Na | Na | Na |
| | | | amt. of blend (wt. %) | 0.20 | 0.20 | — | 0.27 | 0.04 | 0.30 |
| | | (B)*2 | R*3 | coconut ($C_{12}$, $C_{14}$) | — | n-$C_{12}H_{25}$ | n-$C_{12}H_{25}$ | n-$C_{14}H_{29}$ | n-$C_{12}H_{25}$ |
| | | | amt. of blend (wt. %) | 0.10 | — | 0.15 | 0.03 | 0.26 | 0.20 |
| | (A) | | | 0.67 | 1.0 | 0 | 0.9 | 0.13 | 0.6 |
| | (A) + (B) [wt. % ratio] | | | | | | | | |
| | (A) + (B) [wt. % ratio] | | | 0.30 | 0.20 | 0.15 | 0.30 | 0.30 | 0.50 |
| Evaluation | detergency | | | ++ | − | − | ± | ± | + |
| | streaks | window glass | | + | − | ± | − | ± | − |
| | | furniture | | + | − | ± | − | ± | − |

Note:
*1component (A): $RO(C_2H_4O)_nSO_3M$
*2component (B):

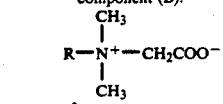

*3n-represents a straight-chain group, and i-represents a branched chain.
*4MEA: monoethanolamine salt
*5coconut alkyl group ($C_{12}$, $C_{14}$ mixed alkyl group)
*6Comparative Example
*7Example according to Present Invention

What is claimed is:

1. A liquid detergent composition comprising:

A) an anionic surfactant- having the formula (I):

$$RO(CH_2CH_2O)_nSO_3M \quad (I)$$

wherein R is a $C_{10}$–$C_{18}$ alkyl or alkenyl group, n is 0 to 5, and

M is hydrogen, an alkaline metal cation, an alkaline earth metal cation, an ammonium cation or a substituted ammonium cation;

(B) an amphoteric ion surfactant having the formula (II):

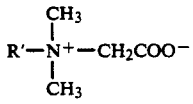

(II)

wherein R′ is a $C_{10}$–$C_{16}$ alkyl or alkenyl group; and (C) water provided that the weight ratio of component (A) to a total amount of components (A) and (B) is 0.2 to 0.8 and the total amount of components (A) and (B) is 0.05% to 0.3% by weight.

2. A liquid detergent composition as claimed in claim 1, wherein the component (A) is an anionic surfactant having the formula (I) wherein R is a $C_{10}$–$C_{16}$ straight-chain alkyl group.

3. A liquid detergent composition as claimed in claim 1, wherein the component (B) is an amphoteric ion surfactant having the formula (II) wherein R′ is a $C_{10}$–$C_{14}$ straight-chain alkyl group.

4. A liquid detergent composition as claimed in claim 1, further comprising an alkaline agent in an amount such that a pH of the composition is 8 to 12.

* * * * *